US010726821B2

(12) United States Patent
Kanada et al.

(10) Patent No.: US 10,726,821 B2
(45) Date of Patent: Jul. 28, 2020

(54) PERFORMANCE ASSISTANCE APPARATUS AND METHOD

(71) Applicant: Yamaha Corporation, Hamamatsu-shi, Shizuoka-Ken (JP)

(72) Inventors: Suzumi Kanada, Hamamatsu (JP); Ushin Tei, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/229,249

(22) Filed: Dec. 21, 2018

(65) Prior Publication Data

US 2019/0122646 A1 Apr. 25, 2019

Related U.S. Application Data

(63) Continuation of application No. PCT/JP2017/021794, filed on Jun. 13, 2017.

(30) Foreign Application Priority Data

Jun. 23, 2016 (JP) ..... 2016-124441

(51) Int. Cl.
*G10H 1/00* (2006.01)
*G10H 1/36* (2006.01)

(52) U.S. Cl.
CPC ..... *G10H 1/0008* (2013.01); *G10H 1/0016* (2013.01); *G10H 1/36* (2013.01);
(Continued)

(58) Field of Classification Search
CPC ..... G10H 1/0008; G10H 1/0016; G10H 1/36
(Continued)

(56) References Cited

U.S. PATENT DOCUMENTS 4,745,836 A * 5/1988 Dannenberg ..... G10H 1/36 84/610
5,521,323 A * 5/1996 Paulson ..... G10H 1/361 84/610

(Continued)

FOREIGN PATENT DOCUMENTS

JP 7-306680 A 11/1995
JP 8-160948 A 6/1996

(Continued)

OTHER PUBLICATIONS

Japanese-language Office Action issued in counterpart Japanese Application No. 2016-124441 dated Nov. 26, 2019 with English translation (seven (7) pages).

(Continued)

*Primary Examiner* — David S Warren
*Assistant Examiner* — Christina M Schreiber
(74) *Attorney, Agent, or Firm* — Crowell & Moring LLP

(57) ABSTRACT

A performance assistance apparatus includes a sound generator circuit and a processor. In response to detection of a sound generation timing, the processor determines whether or not the sound indicated by the user performance information matches the sound designated by the model performance information in association with the sound generation timing. Based on determination that the sound indicated by the user performance information does not match the sound designated by the model performance information, the processor causes the sound generator to audibly generate an assist sound relating to the sound designated by the model performance information.

17 Claims, 4 Drawing Sheets

(52) U.S. Cl.
CPC . *G10H 2210/066* (2013.01); *G10H 2210/076* (2013.01); *G10H 2210/091* (2013.01); *G10H 2220/005* (2013.01)

(58) Field of Classification Search
USPC ..... 84/609
See application file for complete search history.

(56) References Cited

U.S. PATENT DOCUMENTS

| | | | | | |
|---|---|---|---|---|---|
| 5,693,903 | A * | 12/1997 | Heidorn | G10H 1/361 | 84/609 |
| 5,739,453 | A * | 4/1998 | Chihana | G10H 1/26 | 84/611 |
| 5,955,692 | A * | 9/1999 | Hayashi | G10H 1/0008 | 434/307 A |
| 6,342,665 | B1 * | 1/2002 | Okita | A63F 13/005 | 84/609 |
| 7,157,638 | B1 * | 1/2007 | Sitrick | G10H 1/0008 | 84/477 R |
| 7,332,664 | B2 * | 2/2008 | Yung | G09B 15/00 | 84/454 |
| 7,659,472 | B2 * | 2/2010 | Arimoto | G09B 15/00 | 700/94 |
| 2002/0083818 | A1 * | 7/2002 | Asahi | G09B 15/08 | 84/477 R |
| 2007/0256543 | A1 * | 11/2007 | Evans | G09B 5/04 | 84/609 |
| 2013/0074679 | A1 * | 3/2013 | Minamitaka | G10H 1/0008 | 84/609 |
| 2014/0305287 | A1 * | 10/2014 | Sasaki | G10H 1/0066 | 84/609 |
| 2018/0158358 | A1 * | 6/2018 | Hayafuchi | G09B 15/023 | |
| 2019/0122646 | A1 * | 4/2019 | Kanada | G10H 1/0016 | |
| 2019/0213903 | A1 * | 7/2019 | Ikegami | G09B 15/002 | |
| 2019/0213906 | A1 * | 7/2019 | Ikegami | G10G 1/00 | |
| 2019/0348013 | A1 * | 11/2019 | Kubita | G10G 1/02 | |

FOREIGN PATENT DOCUMENTS

| | | | |
|---|---|---|---|
| JP | 2007-72387 | A | 3/2007 |
| JP | 2007072387 | A * | 3/2007 |

OTHER PUBLICATIONS

International Search Report (PCT/ISA/210) issued in PCT Application No. PCT/JP2017/021794 dated Sep. 5, 2017 with English translation (five (5) pages).

Japanese-language Written Opinion (PCT/ISA/237) issued in PCT Application No. PCT/JP2017/021794 dated Sep. 5, 2017 (four (4) pages).

International Preliminary Report on Patentability (PCT/IB/338 & PCT/IB/373) issued in PCT Application No. PCT/JP2017/021794 dated Jan. 3, 2019, including English translation of document C2 (Japanese-language Written Opinion (PCT/ISA/237) previously filed on Dec. 21, 2018) (seven (7) pages).

* cited by examiner

PERFORMANCE ASSISTANCE APPARATUS AND METHOD

PRIORITY

This application is based on, and claims priority to, JP PA 2016-124441 filed on 23 Jun. 2016 and International Patent Application No. PCT/JP2017/021794 filed on 13 Jun. 2017. The disclosure of the priority applications, in its entirety, including the drawings, claims, and the specification thereof, are incorporated herein by reference.

BACKGROUND

The embodiments of the present invention relate to an apparatus and method for assisting a user in a musical instrument performance by use of assist sounds.

Existing electronic musical instruments execute an automatic performance on the basis of performance data. For instance, an electronic musical instrument may automatically play or perform performance-assisting guide sounds at small volume. Further, an electronic musical instrument may generate rhythm sounds at a timing when a keyboard is to be operated. With each of these electronic musical instruments, a human player can practice a music performance by operating the keyboard to generate sounds, while causing the electronic musical instrument to execute an automatic performance. Because an assist sound, such as a guide sound or a rhythm sound, is generated at each timing when the keyboard is to be operated, the human player can easily grasp the music piece.

SUMMARY

However, when the human player operates the keyboard at the timing when the keyboard is to be operated, the sound generated in response to the player's own operation and the assist sound overlap each other, and consequently, the human player may feel the assist sound to be bothersome.

In view of the foregoing prior art problems, it is one of the objects of the present invention to provide a performance assistance apparatus and method capable of reducing botheration which a human player feels due to generation of an assist sound.

In order to accomplish the aforementioned this and other objects, the inventive performance assistance apparatus includes a sound generator circuit; and a processor that is configured to: acquire model performance information designating, for each sound of a model performance, sound generation timing and the sound; progress a performance time at a designated tempo; in response to a performance operation executed by a user in accordance with a progression of the performance time, acquire user performance information indicative of a sound performed by the user; detect that the sound generation timing designated by the model performance information has arrived in accordance with the progression of the performance time; in response to detection of the sound generation timing, determine whether or not the sound indicated by the user performance information matches the sound designated by the model performance information in association with the sound generation timing; and based on determination that the sound indicated by the user performance information does not match the sound designated by the model performance information, cause the sound generator to audibly generate an assist sound relating to the sound designated by the model performance information.

In order to accomplish the aforementioned objects, the inventive musical instrument includes a device operable by a user; a sound generator circuit that generates a sound performed on the performance operator device; and a processor device that is configured to: acquire model performance information designating, for each sound of a model performance, sound generation timing and the sound; progress a performance time at a designated tempo; in response to a performance operation executed by a user in accordance with a progression of the performance time, acquire user performance information indicative of a sound performed through the performance operator device by the user; detect that the sound generation timing designated by the model performance information has arrived in accordance with the progression of the performance time; in response to detection of the sound generation timing, determine whether or not the sound indicated by the user performance information matches the sound designated by the model performance information in association with the sound generation timing; and based on determination that the sound indicated by the user performance information does not match the sound designated by the model performance information, cause the sound generation device to audibly generate an assist sound relating to the sound designated by the model performance information.

According to the inventive performance assistance apparatus, if the sound indicated by the user performance information does not match the sound designated by the model performance information, an assist sound is generated which relates to the sound designated by the model performance information. Namely, the assist sound is generated when the user performance does not match the model performance, rather than being always generated. Because such an assist sound is not generated when an appropriate user performance matching the model performance has been executed, the inventive performance assistance apparatus can prevent overlapping generation of the appropriate performance sound based on the user's own operation and the assist sound, with the result that the inventive performance assistance apparatus can carry out performance assistance by use of the assist sound without causing the user to feel botheration.

Also, disclosed herein is an inventive software program executable by a processor, such as a computer or a signal processor, as well as a computer-readable, non-transitory storage medium storing such a software program. In such a case, the program may be supplied to the user in the form of the storage medium and then installed into a computer of the user, or alternatively, delivered from a server apparatus to a computer of a client via a communication network and then installed into the computer of the client. Further, the processor or the processor device employed herein may be a dedicated processor provided with a dedicated hardware logic circuit rather than being limited only to a computer or other general-purpose processor capable of running a desired software program.

BRIEF DESCRIPTION OF DRAWINGS

Certain embodiments of the present invention will hereinafter be described in detail, by way of example only, with reference to the accompanying drawings, in which.

DETAILED DESCRIPTION

Figure 1:
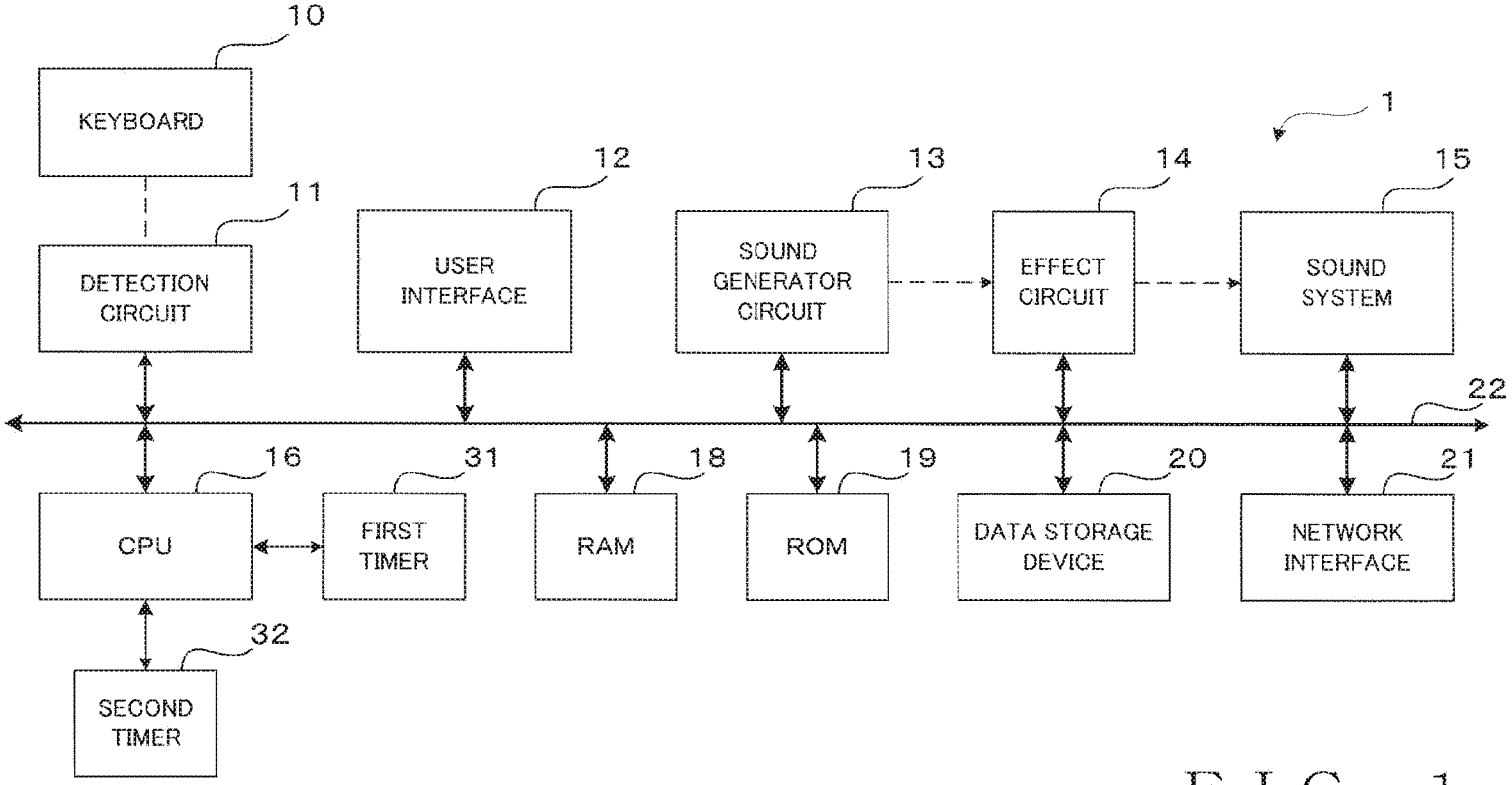
FIG. 1 is a block diagram illustrating an electrical construction of an electronic keyboard musical instrument embodying an embodiment of a performance assistance apparatus.

An electrical construction of an electronic keyboard musical instrument 1 will be described with reference to FIG. 1. The electronic keyboard musical instrument 1 embodying an embodiment of the inventive performance assistance apparatus has not only a function for generating a performance sound in response to a human player operating a keyboard but also a lesson function (namely, a performance assistance function implemented by the inventive performance assistance apparatus), and the like.

The electronic keyboard musical instrument 1 includes, among others, a keyboard 10, a detection circuit 11, a user interface 12, a sound generator circuit 13, an effect circuit 14, a sound system 15, a CPU 16 (namely, processor device), a first timer 31, a second timer 32, a RAM 18, a ROM 19, a data storage device 20, and a network interface 21. The CPU 16 controls various sections of the instrument 1 by executing various programs stored in the ROM 19. Here, the "various sections" are the detection circuit 11, user interface 12, sound generator circuit 13, network interface 21, etc. that are connected to the CPU 16 via a bus 22. The RAM 18 is used as a main storage device to be used by the CPU 16 to perform various processes. The data storage device 20 stores, among others, music piece data of a MIDI (Musical Instrument Digital Interface (registered trademark)) format. The data storage device 20 is implemented, for example, by a flash memory. The first and second timers 31 and 32 perform their respective time counting operations and output signals to the CPU 16 once their respective set times arrive.

The keyboard 10 includes pluralities of while keys and black keys corresponding to various pitches (sound pitches). A music performance is executed by a user (human player) using the keyboard 10. The detection circuit 11 detects each human player's performance operation on the keys of the keyboard 10 and transmits a performance detection signal to the CPU 16 in response to the detection of the key performance operation. On the basis of the performance detection signal received from the detection circuit 11, the CPU 16 generates performance data of a predetermined data format, such as a MIDI format. Thus, in response to the performance operation by the user, the CPU 16 acquires the performance data the performance data indicative of a sound performed by the user (namely, user performance information).

The sound generator circuit 13 performs signal processing on data of the MIDI format so as to output a digital audio signal. The effect circuit 14 imparts an effect, such as reverberation, to an audio signal output from the sound generator circuit 13 to thereby output an effect-imparted digital audio signal. The sound system 15 includes, among others, a digital-to-analog converter, an amplifier, and a speaker that are not shown in the drawings. The digital-to-analog converter converts the digital audio signal output from the effect circuit 14 to an analog audio signal and outputs the converted analog audio signal to the amplifier. The amplifier amplifies the analog audio signal and outputs the amplified analog audio signal to the speaker. The speaker sounds or audibly generates a sound corresponding to the analog audio signal input from the amplifier. In this manner, the electronic keyboard musical instrument 1 audibly generates, in response to a user's operation on the keyboard 10, a performance sound manually performed by the user. The electronic keyboard musical instrument 1 also has an automatic performance function for audibly generating an automatic sound on the basis of music piece data stored in the data storage device 20. In the following description, audibly generating an automatic sound is sometimes referred to as reproducing or reproduction.

The user interface 12 includes a liquid crystal display and a plurality of operating buttons, such as a power button and a "start/stop" button, which are not shown in the drawings. The user interface 12 displays various setting screens etc. on the liquid crystal display in accordance with instructions given by the CPU 16. Further, the user interface 12 transmits to the CPU 16 a signal representative of an operation received via any one of the operating buttons. The network interface 21 executes LAN communication. The CPU 16 is connectable to the Internet via the network interface 21 and a not-shown router so as to download desired music piece data from a content server that is connected to the Internet so as to supply music piece data via the Internet. Note that the CPU 16 stores the downloaded music piece data into the data storage device 20.

Note that the user interface 12 is located in a rear portion of the keyboard 10 as viewed from the human player operating the keyboard 10. Thus, the human player can perform a music piece while viewing display shown on the liquid crystal display.

Next, a description will be given of the lesson function (namely, performance assistance function) of the electronic keyboard musical instrument 1. The electronic keyboard musical instrument 1 has a plurality of forms of the lesson function. As an example, the purpose of the lesson here is to allow the human player (user) to master a performance of a right-hand performance part and/or a left-hand performance part of a music piece, and the following description will be given of the form of the lesson function in which the electronic keyboard musical instrument 1 causes an automatic performance of an accompaniment part of the music piece to progress with the passage of time, and in which the musical instrument 1 interrupts the progression of the music piece until a correct key is depressed by the human player (user) and resumes the progression of the music piece once the correct key is depressed by the human player. According to the lesson function, once the human player depresses the "start/stop" button, the accompaniment part corresponding to an intro section of the music piece (described later) is reproduced. When sound generation timing at which the human player should depress a key approaches in accordance with a progression of the music piece, the electronic keyboard musical instrument 1 guides the player, ahead of the sound generation timing, about a pitch to be performed by use of a musical score or a schematic view of the keyboard (described later) displayed on the liquid crystal display. Once the sound generation timing arrives, the electronic keyboard musical instrument 1 interrupts the accompaniment until the key to be depressed is depressed by the human player. If a predetermined time elapses from the sound generation timing without the to-be-depressed key being depressed by the human player, the electronic keyboard musical instrument 1 keeps audibly generating a guide sound until the to-be-depressed key is depressed by the human player. Here, the guide sound is an assist sound that is generated for performance assistance. As an example, the assist sound is a sound which has the same pitch as the key to be depressed (i.e., a pitch of a model performance) but has a timbre different from that of a sound that is audibly generated when the key is depressed by the human player (i.e., different from a timbre of the sound performed by the user). Once the to-be-depressed key is depressed by the human player, the electronic keyboard musical instrument 1 resumes the reproduction of the accompaniment.

The following description will be given of a screen displayed on the liquid crystal display during execution of the lesson function. On the displayed screen are shown a name of a music piece being performed, and a musical score, for example in a staff format, of a portion of the music piece at and in the vicinity of a position being currently performed or a schematic plan diagram of the keyboard 10. Once sound generation timing approaches, a pitch to be performed is clearly indicated on the musical score or the schematic plan diagram of the keyboard 10 in such a manner that the human player can identify a key to be depressed. Clearly indicating a pitch to be performed as above will hereinafter be referred to as "guide display" or "guide-displaying". Further, a state in which such guide display is being executed will be referred to as "ON state", and a state in which such guide display is not being executed will be referred to as "OFF state". Furthermore, timing for executing such guide display will be referred to as "guide display timing", and timing for audibly generating a guide sound (assist sound) will be referred to as "guide sound timing".

Next, a description will be given of music piece data corresponding to the lesson function. The music piece data is constituted by a plurality of tracks. Data for a right-hand performance part in the lesson function is stored in the first track, and data for a left-hand performance part in the lesson function is stored in the second track. Accompaniment data is stored in the other track. In the following description, the first track, the second track, and the other track will sometimes be referred to as "right-hand part", "left-hand part", and "accompaniment part", respectively.

In each of the tracks, data, each having a set of time information and an event, are arranged in a progression order of the music piece. Here, the event is data instructing content of processing, and the time information indicative of a time of the processing. Examples of the event include a "note-on" event that is data instructing generation of a sound. The "note-on" event has attached thereto a "note number", a "channel", and the like. The note number is data designating a pitch. What kind of timbre should be allocated to the channel is designated separately in the music piece data. Note that the time information of each of the tracks is set in such a manner that all of the tracks progress simultaneously.

Figure 2:
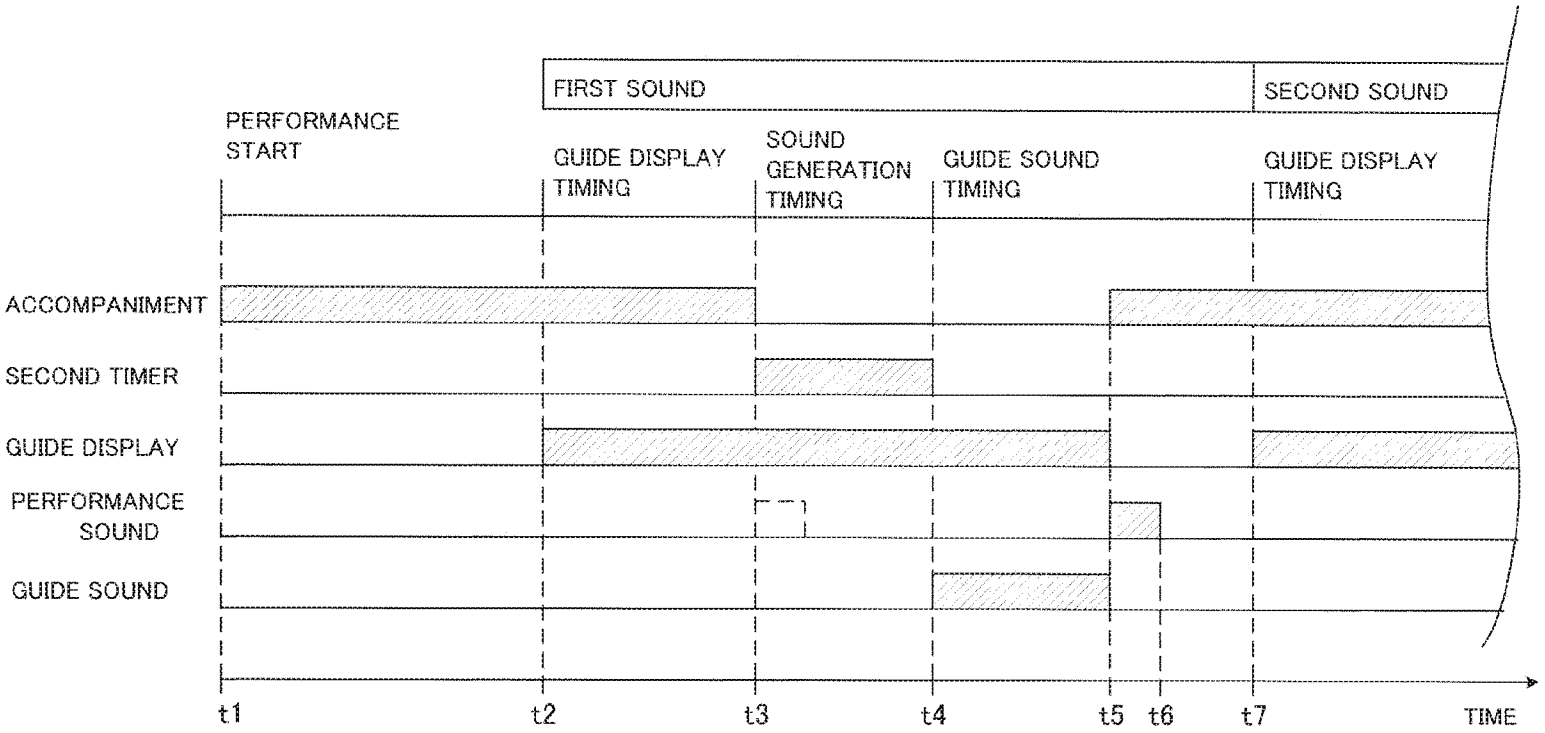
FIG. 2 is a time chart explaining a lesson function and a performance guide process.

Next, with reference to FIG. 2, the lesson function will be described in relation to a case in which the human player has depressed a key later than the sound generation timing. FIG. 2 is a mere schematic view and is never intended to limit time intervals between individual timing to those illustrated in the figure. Respective hatched portions of the guide display, the performance sound, and the guide sound indicate time periods when sound generation or guide display is being executed. A hatched portion of the second timer indicates a period when the second timer is counting. Once the "start/stop" button is depressed, the electronic keyboard musical instrument 1 starts reproduction of the accompaniment part (t1). Once the guide display timing arrives, the electronic keyboard musical instrument 1 turns on the guide display (t2), or puts the guide display in the ON state. Once the sound generation timing arrives, the electronic keyboard musical instrument 1 interrupts the reproduction of the accompaniment part (t3). Then, once the guide sound timing arrives without the key being depressed by the human player at the sound generation timing (t3), the electronic keyboard musical instrument 1 audibly generates the guide sound (t4). Then, once the key is depressed by the human player at time point t5, the electronic keyboard musical instrument 1 shifts the guide display to the OFF state, stops the generation of the guide sound, and resumes the reproduction of the accompaniment part. Further, the electronic keyboard musical instrument 1 starts generation of a performance sound in response to the user's key depression. Then, once the key is released by the human player at time point t6, the electronic keyboard musical instrument 1 stops the generation of the performance sound. Then, once the guide display timing for the second sound arrives at time point t7, the electronic keyboard musical instrument 1 operates in the same manner as for the first sound.

Next, with reference to FIG. 3, a description will be given of performance processing executed by the CPU 16 in the lesson function. Upon powering-on, the CPU 16 starts the performance processing. The human player, who wants to use the lesson function, first operates any one of the operating buttons of the user interface 12 to select, from among various music piece data stored in the data storage device 20, music piece data on which the player wants to take a lesson. The CPU 16 reads out, from the data storage device 20, the music piece data of the selected music piece and stores the read-out music piece data into the RAM 18 (step S1). Then, the human player operates some of the operating buttons of the user interface 12 to make various settings. These various settings include a setting of a tempo value, a setting as to which one of the left-hand and right-hand parts is set as a performance lesson part to be practiced by the player, and the like. In the following example, it is assumed that the human player has selected the right-hand part as the performance lesson part. The CPU 16 stores the settings of the tempo and the performance lesson part into the RAM 18, and the CPU 16 also sets each of a key depression wait flag and a second timer flag, which will be described later, at an initial value of 0 (step S3).

Then, at step S5, the CPU 16 extracts, from the music piece data of the selected music piece, all "note-on" events of the right-hand part set as the performance lesson part and time information corresponding to the "note-on" events, acquires these "note-on" events and time information as model performance information, creates "guide display events" for a conventionally known performance guide on the basis of the model performance information ("note-on" events and time information), and stores the thus-created guide display events into the RAM 18. The model performance information is information designating sound generation timing and a sound (e.g., note name) for each sound of a model performance of the performance lesson part. Typically, the model performance information is constituted by a data group of the "note-on" events and corresponding time information of the model performance. Thus, more specifically, at step S5, the CPU 16 extracts, from the music piece data of the selected music piece, all of the "note-on" events of the right-hand part set as the performance lesson part, and for each of the extracted note-on events, the CPU 16 calculates second time information indicative of a time point preceding by a predetermined time the sound generation timing indicated by the first time information (namely, time information indicative of actual sound generation timing) corresponding to the note-on event, creates a "guide display event" having a message (including a note number indicative of a pitch) that is the same as a message possessed by the corresponding "note-on" event (including the note number indicative of the pitch), and stores the thus-created "guide display event" into the RAM 18 in association with the calculated second time information (step S5). Here, the above-mentioned predetermined time is a time length corresponding to, for example, a note value of a thirty-second note. The second time information calculated here is indicative of guide display timing. In the following description, data having a plurality of sets of the "guide display events" and the guide display timing associated with each other will be referred to as "guide display data". As noted above, each of the "guide display events" has attached thereto a "note number".

Then, upon detection that the "start/stop" button has been depressed by the human player (step S7), the CPU 16 starts reproduction of the music piece data (step S9, or time point t1 of FIG. 2). More specifically, the CPU 16 sequentially reads out the events and time information of the accompaniment part and executes, in accordance with the set tempo, the read-out events at timing based on the read-out time information. In this manner, the reproduction of the accompaniment part is started. Further, the CPU 16 starts readout of the data of the right-hand part and the guide display data. At this time, the CPU 16 may also start readout of the data of the left-hand part to execute reproduction of the left-hand part. Note that the CPU 16 is configured to determine, using the first timer 31 and on the basis of the time information, tempo, etc., whether predetermined timing has arrived and thereby progress a performance time in accordance with the set tempo.

Then, the CPU 16 determines whether or not the performance is to be ended (step S11). When the "start/stop" button has been depressed, or when the music piece data has been read out up to the last, the CPU 16 determines that the performance is to be ended. Upon determination that the performance is to be ended (YES determination at S11), the CPU 16 ends the performance. Upon determination that the performance is not to be ended (NO determination at S11), the CPU 16 performs a performance guide process (step S13).

The performance guide process will now be described with reference to FIGS. 4 and 5 in relation to the illustrated example of FIG. 2. In the performance guide process, the CPU 16 uses the second timer 32. A predetermined time from sound generation timing to guide sound timing is set as a counting operation time of the second timer 32; here, the predetermined time from sound generation timing to guide sound timing is set in advance, for example, at 600 ms. Further, the CPU 16 uses the second timer flag. When the value of the second timer flag is "1", the flag indicates that the counting has ended, while the value of the second timer flag is "0", the flag indicates that the counting has not yet ended. Once the CPU 16 receives from the second timer 32 a signal indicating that the remaining counting operation time is zero, the CPU 16 updates the value of the second timer flag to "1".

In the performance guide process, the CPU 16 also uses the key depression wait flag. When the value of the key depression wait flag is "1", the flag indicates that the musical instrument 1 is currently in a key depression wait state. When the value of the depression wait flag is "0", the flag indicates that the musical instrument 1 is not currently in the key depression wait state.

Then, upon start of the performance guide process, the CPU 16 refers to the key depression wait flag to determine whether or not the musical instrument 1 is currently in the key depression wait (step S21). At the time of first execution of step S21, the key depression wait flag is at the initial value "0", and thus, the CPU 16 determines that the musical instrument 1 is not currently in the key depression wait (NO determination at step S21).

Then, on the basis of the time information corresponding to the "guide display event" read out from the guide display data, the CPU 16 whether or not the guide display timing has arrived (step S23). Upon determination that the guide display timing has arrived (YES determination at step S23), the CPU 16 instructs the user interface 12 to display (guide-display) a pitch corresponding to the "note number" attached to the "guide display event" (step S25, or t2 in FIG. 2). In this manner, the guide display is put in the ON state. On the other hand, upon determination that the guide display timing has not yet arrived (NO determination at step S23), the CPU 16 skips step S25.

Once the display timing arrives (YES determination at step S23), the electronic keyboard musical instrument 1 executes the guide display ahead of the sound generation timing (step S25). If the human player is a beginner player, the player may often first view the guide display on the liquid crystal display, then transfer his or her gaze to the keyboard 10 to look for a key to be depressed, and then depresses the key. Further, the less experienced the human player is, the longer time does the player tend to take before he or she find the to-be-depressed key on the keyboard 10 by viewing the guide display. Thus, by the guide display being executed ahead of the sound generation timing as noted above, the human layer may often be enabled to depress the to-be-depressed key at the sound generation timing, with the result that the lesson can be carried out smoothly with interruption of the progression of the music piece effectively restrained.

Then, the CPU 16 detects (determines) whether or not the sound generation timing indicated by the time information corresponding to the "note-on" event read out from the track of the right-hand part (namely, the sound generation timing of the model performance) has arrived (step S27). Upon detection (determination) that the sound generation timing has arrived (YES determination at step S27), the CPU 16 updates the value of the key depression wait flag to "1" and stops the reproduction of the music piece data (step S29). More specifically, the CPU 16 stops readout of the data of the accompaniment part and the right-hand part and the guide display data. Note that in this example, the CPU 16 does not execute automatic generation of a tone responsive to the corresponding note-on event (i.e., model performance sound) when the sound generation timing has arrived. Then, the CPU 16 instructs the second timer 32 to start counting (step S31, or t3 in FIG. 2).

Then, on the basis of a performance detection signal output from the detection circuit 11, the CPU 16 determines whether or not any key has been depressed (step S33). In the illustrated example of FIG. 2, any key has not yet been depressed by the human player at time point t3, and thus, the CPU 16 determines that no key has been depressed (NO determination at step S33). Then, the CPU 16 determines whether or not the guide sound timing has arrived (step S53). The CPU 16 refers to the second timer flag, and if the value of the second timer flag is "1", the CPU 16 determines that the guide sound timing has arrived. In the illustrated example of FIG. 2, the guide sound generation timing has not arrived by time point t4, and thus, the CPU 16 determines that the guide sound generation timing has not yet arrived (NO determination at step S53). Then, the CPU 16 branches to step S59 to further determine whether or not a depressed key has been released by the human player. If a depressed key has not yet been released by the human player, the CPU 16 determines that the depressed key has not been released (NO determination at step S59) and then ends one routine of the performance guide process shown in FIGS. 4 and 5.

Figure 3:
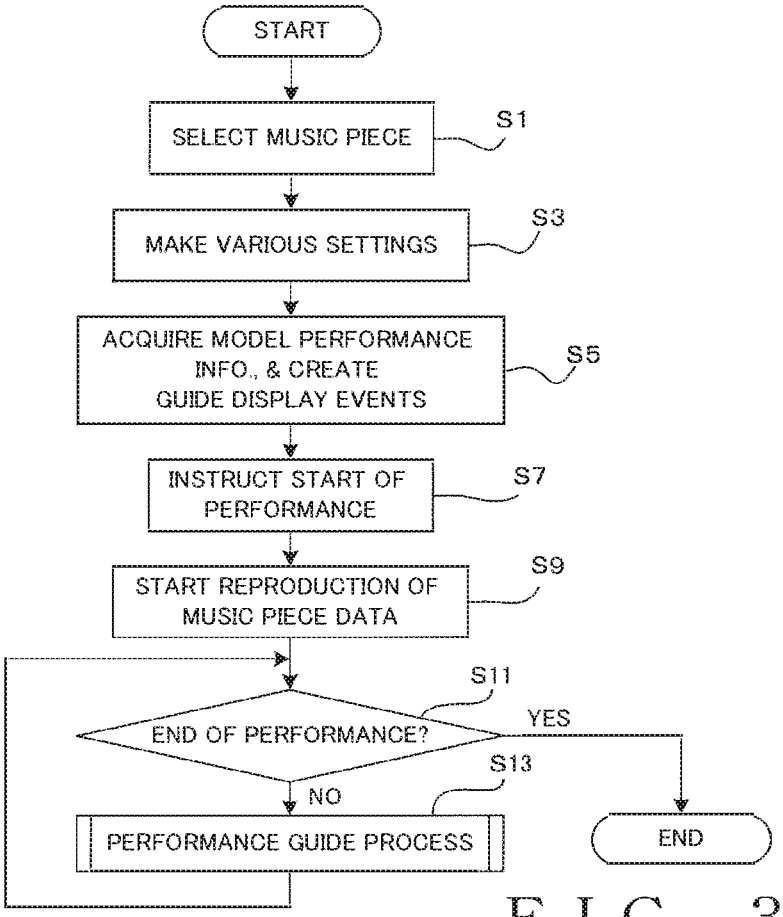
FIG. 3 is a flow chart illustrating details of performance processing.
Figure 4:
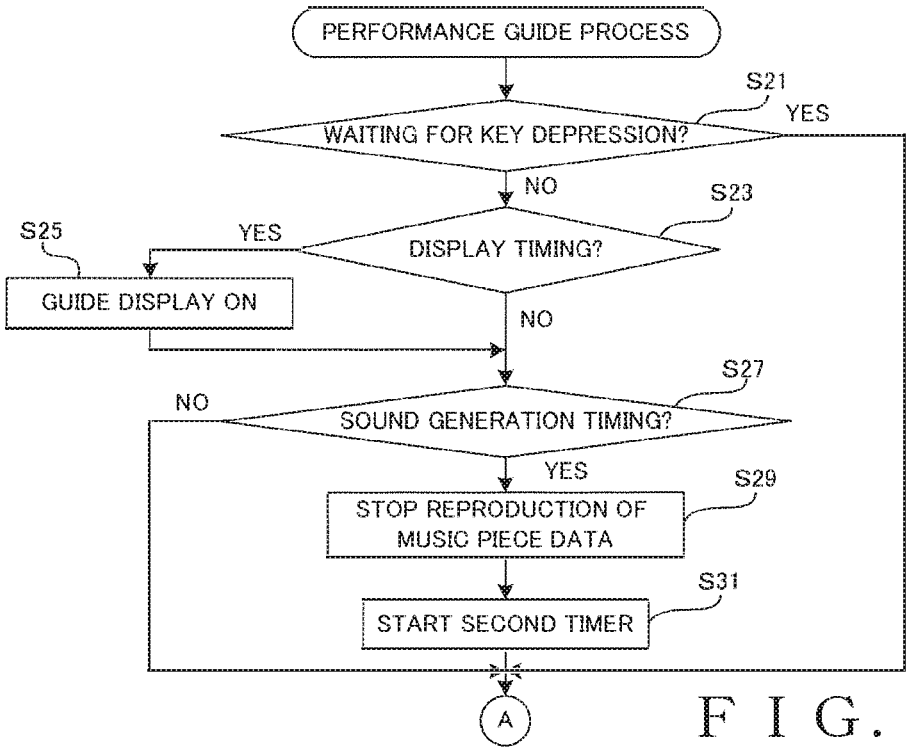
FIG. 4 is a flow chart illustrating details of a former half of the performance guide process.
Figure 5:
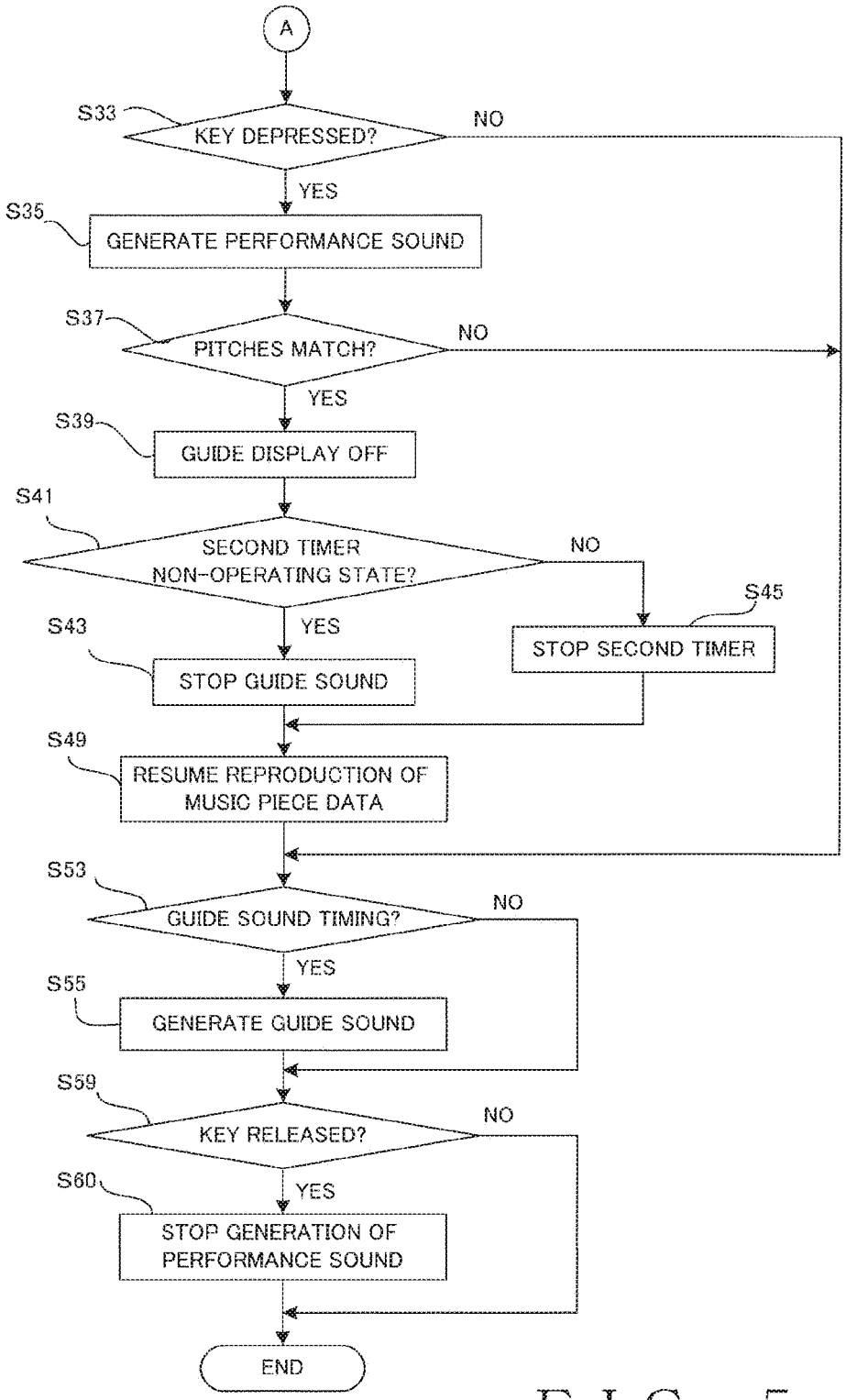
FIG. 5 is a flow chart illustrating details of a latter half of the performance guide process.

During a time period from time point t3 to time point t4, i.e., until the guide sound timing arrives without any key being depressed by the human player, namely, until the second timer 32 finishes counting, the CPU 16 repeats the performance guide process 13 (i.e., the route of the YES determination at step S21, NO determination at step S33, NO determination at step S53, and NO determination at step S59 in FIGS. 4 and 5) by way of the NO determination at step S11 in FIG. 3.

Once the counting by the second timer 32 is finished at time point t4, the CPU 16 passes through a route of the NO determination at step S11, YES determination at step S21, and NO determination at step S33 in FIGS. 4 and 5, and then, the CPU 16 determines at step S53 that the guide sound timing has arrived (YES determination at step S53) because the value of the second timer flag is "1". Then, the CPU 16 proceeds to step S55 to generate a guide sound. The CPU 16 instructs the sound generator circuit 13 to generate a guide sound of the "note number" attached to the "note-on" event having been read out and stored into the RAM 18 at step S27. Further, the CPU 16 updates the value of the second timer flag to "0". Because the guide sound is generated at the pitch of the model performance after the key indicating the pitch of the model performance is guide-displayed as noted above, the human player can identify correspondence between the guide-displayed key and the pitch. After that, the CPU 16 proceeds to step S59, and if a NO determination is made at step S59, the CPU 16 ends the one round of the performance guide process.

After time point t4 of FIG. 2, the CPU 16 repeats the performance guide process shown in FIGS. 4 and 5 while passing through a route of the YES determination at step S21, NO determination at step S33, NO determination at step S53, and NO determination at step S59, until the CPU 16 determines that a key has been depressed by the human player (i.e., until a YES determination is made at step S33).

Once a key is depressed by the human player at time point t5 in FIG. 2, the CPU 16 determines that a key has been depressed (YES determination at step S33). Then, the CPU 16 proceeds to step S35 to instruct the sound generator circuit 13 to generate a performance sound (i.e., a sound corresponding to the key depressed by the human player). Next, the CPU 16 determines whether or not the pitch corresponding to the depressed key matches the guide-displayed pitch (i.e., the pitch of the model performance) (step S37). More specifically, the CPU 16 determines whether or not the sound corresponding to the depressed key and the pitch indicated by the "note number" attached to the "note-on" event read out at step S27 match each other. Upon determination that the two pitches match each other (YES determination at step S37), the CPU 16 instructs the user interface 12 to put the guide display in the OFF state and updates the value of the key depression wait flag to "0" (step S39). Then, the CPU 16 determines whether or not the second timer 32 is currently in a non-operating state (step S41). Upon determination that the second timer 32 is currently in the non-operating state (YES determination at step 41), the CPU 16 instructs the sound generator circuit 13 to stop the generation of the guide sound (step S43).

Then, the CPU 16 resumes the reproduction of the music piece data (step S49). More specifically, the CPU 16 resumes the readout of the data of the accompaniment part and right-hand part data and the guide display data. Then, because the value of the second timer flag is currently "0", the CPU 16 determines that the guide display timing has not arrived yet (NO determination at step S53), and thus, the CPU 16 branches to step S59. The CPU 16 determines that the key has been released at time point t6 of FIG. 2 (YES determination at step S59), and thus, the CPU 16 stops the generation of the performance sound (step S60) and ends the process.

The performance guide process will be described further in relation to a case where the to-be-depressed key has been depressed at the sound generation timing. In this case, the second timer 32 starts counting at step S31, and the CPU 16 makes a YES determination at next step S33 and then executes subsequence steps S35 to S41. In this case, because the CPU 16 determines that the second timer 32 is not in the non-operating state, the CPU 16 branches from such a NO determination at step S41 to step S45. At step S45, the CPU 16 deactivates, or stops the counting operation of, the second timer 32 and proceeds to step S49. Then, because the value of the second timer flag is currently "0", the CPU 16 determines that the guide sound timing has not arrived yet (NO determination at step S53) and jumps over step S55 to step S59. Namely, when the human player has been able to depress the to-be-depressed key prior to the arrival of the guide sound timing, only the performance sound is generated without the guide sound being generated.

Further, when the CPU 16 determines that the pitch corresponding to the depressed key does not match the guide-displayed pitch (pitch of the model performance) (NO determination at step S37), the CPU 16 proceeds to step S53, skipping steps S39 to S49. In this manner, when the human player has not depressed the to-be-depressed key, the guide sound continues being generated in such a manner that the human player can continue listening to the guide sound until he or she depresses the to-be-depressed key (i.e., the pitch of the model performance).

In the above-described embodiment, the plurality of sets of data, each having the "note-on" event and the time information corresponding to the "note-on" event, relating to a music piece which the human player wants to take a lesson on are an example of model performance information that, for each sound of the model performance, designates sound generation timing and the sound. Here, the time information corresponding to the individual "note-on" events is an example of information indicative of the sound generation timing of the model performance designated by the model performance information, and the "note number" included in each of the "note-on" events is an example of pitch information as a form of information indicative of a sound of the model performance designated by the model performance information. Further, the keyboard 10 is an example of a performance operator unit or a performance operator device, and the performance detection signal output in response to a key operation on the keyboard 10 is an example of user performance information. The aforementioned arrangements where the CPU 16 at step S5 extracts all of the "note-on" events and the corresponding time information of the performance part, set as the performance lesson part, from the music piece data of the selected music piece stored in the RAM 18 and acquires the extracted note-on events and time information as the model performance information is an example of a means for acquiring the model performance information that designates sound generation timing and a sound for each sound of the model performance. Further, the aforementioned arrangements where the CPU 16 at step S9 starts the reproduction of the music piece data and progresses, by use of the first timer 31, the performance time at the tempo set at step S3 is an example of a means for progressing the performance time at a designated tempo. Furthermore, the aforementioned operation performed by the CPU 16 for receiving the performance detection signal via the detection circuit 11 is an example of a means that, in response to a performance operation executed by a user in accordance with a progression of the performance time, acquires user performance information indicative of a sound performed by the user. Furthermore, the aforementioned operation of step S27 performed by the CPU 16 is an example of a detection means for detecting that the sound generation timing, designated by the model performance information, has arrived in accordance with the progression of the performance time. Furthermore, the aforementioned arrangements where the CPU 16 determines at step S33 whether or not any key has been depressed and where any key has been depressed as determined at step S33, the CPU 16 further determines at step S37 whether or not the pitches match each other are an example of a determination means that determines, in response to detection of the sound generation timing, whether or not the sound indicated by the user performance information matches the sound designated by the model performance information in association with the sound generation timing. Namely, in the operation of step S33 performed in response to the detection of the sound generation timing, the determination that no key has been depressed is basically equivalent to a case where the sound indicated by the user performance information does not match the sound designated by the model performance information. Further, in the operation of step S37 performed in response to the detection of the sound generation timing, the determination that the pitch of the depressed key and the pitch of the note number of the note-on event do not match each other is, of course, equivalent to a case where the sound indicated by the user performance information does not match the sound designated by the model performance information. Furthermore, the sound system 15 is an example of an audible sound generation means. Moreover, the aforementioned arrangements where the CPU 16 performs the operation for generating the guide sound at step S55 and the sound system 15 generates the guide sound in response to such a guide sound generating operation is an example of an assist sound generation means that audibly generates an assist sound, relating to the sound designated by the model performance information, on the basis of the determination that the sound indicated by the user performance information does not match the sound designated by the model performance information. The operation of step S55 is an example of "audibly generating a sound based on pitch information". Furthermore, the operational sequence where the CPU 16 executes various steps (YES determination at step S37, step S39, NO determination at step S41, step S45, step S49, and NO determination at step S53) and then skips step S55 is an example of "not audibly generating a sound based on pitch information".

Furthermore, the aforementioned arrangements where the CPU 16 starts the counting operation of the second timer 32 at step S31, sets the value of the second timer flag to "1" once the counting operation time (predetermined time) of the second timer 32 expires, determines, if the value of the second timer flag is "1" at step S53, that the guide sound timing has arrived in such a manner that the CPU 16 executes the operation for generating a guide sound at step S55, but skips step S55 if the value of the second timer flag is not "1" at step S53 is an example of arrangements where the assist sound generation means waits for a predetermined time from the sound generation timing and audibly generates the assist sound if it is not determined during the predetermined time that the sound indicated by the user performance information matches the sound designated by the model performance information, but does not audibly generate the assist sound if it is determined during the predetermined time that the sound indicated by the user performance information matches the sound designated by the model performance information. Furthermore, the aforementioned arrangements where the CPU 16 executes the operation of step S43 by way of the YES determination made at step S37 are an example of arrangements where the assist sound generation means stops the assist sound once it is determined, after generating the assist sound, that the sound indicated by the user performance information matches the sound designated by the model performance information. Furthermore, the aforementioned arrangements where the CPU 16 executes the operation of step S25 by way of the YES determination made at step S23 is an example of a performance guide means that visually guides the user about a sound to be performed by the user in accordance with the progression of the performance time. Moreover, the operational sequence where the CPU 16 updates the value of the key depression wait flag to "1" in response to the execution of step S27 (YES determination made at step S27) and executes, based on the value of the key depression wait flag at step S21, executes, on the basis of the value of the key depression wait flag at step S21, step S37 following the sound generation timing is an example of a first acquisition means. Furthermore, step S23 is an example of a second acquisition means. Step 3 is an example of a music piece acquisition means, and the user interface 12 is an example of a display means.

In the above-described embodiment, a main construction that implements the inventive performance assistance apparatus and/or method is provided by the CPU 16 (namely, processor or processor device) executing a necessary computer program or processing procedure. Namely, the inventive performance assistance apparatus according to the above-described embodiment includes the processor (CPU 16) which is configured to: acquire, for each sound of the model performance, model performance information designating sound generation timing and the sound (S5); progress a performance time at a designated tempo (S3, S9, and S31); acquire, in response to a performance operation executed by the user in accordance with a progression of the performance time, user performance information indicative of a sound performed by the user (11); detect that sound generation timing designated by the model performance information has arrived in accordance with the progression of the performance time progresses (S27); determine, in response to the detection of the sound generation timing, whether or not the sound indicated by the user performance information matches the sound designated by the model performance information in association with the sound generation timing (S33 and S37); and audibly generate an assist sound (i.e., guide sound) relating to the sound designated by the model performance information, on the basis of the determination that the sound indicated by the user performance information does not match the sound designated by the model performance information (S55).

The embodiment constructed in the above-described manner achieves the following advantageous benefits. In response to the CPU 16 determining that the pitch corresponding to the depressed key does not match the pitch indicated by the "note number" attached to the "sound generation timing" (NO determination at step S37), the electronic keyboard musical instrument 1 generates the guide sound based on the "note number" (S55). When the human player has not been able to successfully operate the key corresponding to the pitch indicated by the "note number" attached to the "sound generation timing", the human player can listen to the guide sound corresponding to the "note number" and can thus identify the sound to be generated. On the other hand, in response to the CPU 16 determining that the pitch corresponding to the depressed key matches the pitch indicated by the "note number" (YES determination at step S37), the CPU 16 determines that the guide sound timing has not arrived yet if the current time point is before the guide sound timing (NO determination at step S53), the CPU 16 jumps over step S55 to step S59, and thus, the electronic keyboard musical instrument 1 does not generate the guide sound based on the "note number". When the human player has been able to successfully operate the key corresponding to the pitch indicated by the "note number" attached to the "sound generation timing", on the other hand, the human player can avoid hearing the sound based on the "note number", namely, the human player can be freed from botheration that would be experienced if the sound based on the "note number" is audibly generated.

Further, the human player can identify each to-be-depressed key by viewing a position of the to-be-depressed key guide-displayed on the liquid crystal display of the user interface 12. Furthermore, because the position of the to-be-depressed key is guide-displayed ahead of the sound generation timing, the human player can identify the position of the key to be depressed next by viewing the guide display.

It should be appreciated that the present invention is not limited to the above-described embodiments and various improvements and modifications of the invention are of course possible without departing from the basic principles of the invention. For example, although the performance processing has been described above as reading out the music piece data from the data storage device 20 and storing the read-out music piece data into the RAM 18 at step S1, the embodiments of the present invention are not so limited, and the music piece data may be read out from the data storage device 20 at step S5 without the music piece data being stored into the RAM 18.

Further, although the music piece data has been described above as being prestored in the data storage device 20, the embodiments of the present invention are not so limited, and the music piece data may be downloaded at step S22 from the server via the network interface 21. Furthermore, the electronic keyboard musical instrument 1 is not limited to the above-described construction and may include an interface that communicates data with a storage medium, such as a DVD or a USB memory, having the music piece data stored therein. Furthermore, although the network interface 21 has been described above as executing LAN communication, the embodiments of the present invention are not so limited. For example, the network interface 21 may be configured to execute communication according to some standards, such as MIDI, USB, and Bluetooth (registered trademark). In such a case, the electronic keyboard musical instrument 1 may be constructed to execute the performance processing by use of music piece data and other data transmitted from communication equipment, such as a PC, that has such music piece data and other data stored therein.

Furthermore, although the music piece data of the model performance has been described above as being data of the MIDI format, the embodiments of the present invention are not so limited, and the music piece data of the model performance may be audio data. In such a case, the electronic keyboard musical instrument 1 may be constructed to execute the performance processing by converting the audio data into MIDI data. Furthermore, although the music piece data has been described above as having a plurality of tracks, the embodiments of the present invention are not so limited, and the music piece data may be stored in only one track.

Furthermore, the electronic keyboard musical instrument 1 has been described above as including the first timer 31 and the second timer 32, the functions of such first and second timers may be implemented by the CPU 16 executing a predetermined program.

Furthermore, although it has been described above in relation to step S5 that the guide display timing indicated by the time information corresponding to the "guide display event" precedes by the note value of a thirty-second note the sound generation timing indicated by the time information corresponding to a "note-on" event, the preceding time is not intended to be limited to a particular fixed time. Furthermore, although the time from the sound generation timing to the guide sound timing is preset at a predetermined time (such as 600 ms), the time is not limited to a particular fixed time. For example, the time from the sound generation timing to the guide sound timing may be a time corresponding to the tempo or may be a time differing per event. For example, the time from the sound generation timing to the guide sound timing may be set at a desired time by the human player at step S3.

Furthermore, although the CPU 16 has been described above as executing step S5 in the performance processing, the operational sequence of the performance processing may be arranged so as not to execute step S5. In such a case, the CPU 16 may be configured to instruct, upon readout of a "note-on" event of the right-hand part at step S23 of the performance guide process, that the guide display be executed a predetermined time before the time information corresponding to the read-out "note-on" event. Further, in such a case, the music piece data may be read out, for example, on a component-data-by-component data basis as the need arises, via a network, such as the network interface 21.

Further, as a specific example of the guide display, each key and note to be displayed may be changed in display color, displayed blinkingly, or the like, Particularly, blinkingly displaying the key and note is preferable in that it can easily catch the eye of the user. Further, the display style of the guide display may be changed between before and after the guide sound timing. Furthermore, although it has been described above that the guide display is put in the OFF state at step S39, the guide display does not necessarily have to be put in the OFF state. In addition, executing the guide display is not necessarily essential; that is, the embodiments of the present invention may be practiced without executing the guide display.

Moreover, although the guide sound (i.e., assist sound) has been described above as being of a timbre different from that of a sound generated in response to depression of a key (i.e., performance sound), the embodiments of the present invention are not so limited, and the guide sound may be of the same timbre as the performance sound. Arrangements may be made such that a desired timbre of the guide sound can be selected by the human player, for example, at step S3. Furthermore, although the guide sound (i.e., assist sound) has been described above as continuing being generated until he or she depresses the to-be-depressed key, the embodiments of the present invention are not so limited, and arrangements may be made such that the guide sound continues being generated for a predetermined time length.

Arrangements may be made such that a desired note value can be selected by the human player, for example, at step S3. Furthermore, although it has been described above that the guide display is put in the ON state in response to the CPU 16 determining that the display timing has arrived (YES determination at step S23), the embodiments of the present invention are not so limited, and arrangements may be made for enabling the human player to select whether the guide display should be executed or not. Although, in the above-described embodiment, the sound designated by the model performance information corresponds to a sound pitch and a guide sound (assist sound) relating to the pitch is audibly generated, the embodiments of the present invention are not so limited. For example, the sound designated by the model performance information may correspond to a percussion instrument sound, and a guide sound (i.e., assist sound) relating to such a percussion instrument sound may be audibly generated.

Moreover, although the electronic keyboard musical instrument 1 has been described above as a performance instruction apparatus, the embodiments of the present invention are applicable to performance assistance (performance guide) for any types of musical instruments. Further, the inventive performance assistance apparatus and/or method may be implemented by constructing various structural components thereof, such as the performance operator unit, operation acquisition means, timing acquisition means, detection means, determination means, and sounding means, as mutually independent components, and interconnecting these components via a network. Furthermore, the performance operator unit may be implemented, for example, by a screen displayed on a touch panel and showing a keyboard-simulating image, a keyboard, or another musical instrument. The operation acquisition means may be implemented, for example, by a microphone that picks up sounds, Moreover, the timing acquisition means, detection means, determination means, and the like may be implemented, for example, by a CPU provided in a PC. The determination means may be configured to make a determination by comparing waveforms of audio data. Furthermore, the sounding means may be implemented, for example, by a musical instrument including an actuator that mechanically drives a keyboard and the like.

The foregoing disclosure has been set forth merely to illustrate the embodiments of the invention and is not intended to be limiting. Since modifications of the disclosed embodiments incorporating the spirit and substance of the invention may occur to persons skilled in the art, the invention should be construed to include everything within the scope of the appended claims and equivalents thereof

What is claimed is:

1. A performance assistance apparatus comprising:

a sound generator circuit;

an accompaniment sound generator configured to audibly generate an accompaniment sound in accordance with a progression of a performance time;

a processor configured to:

acquire model performance information designating, for each sound of a model performance, sound generation timing and sound;

progress the performance time at a designated tempo;

in response to a performance operation executed by a user in accordance with the progression of the performance time, acquire user performance information indicative of a sound performed by the user;

detect that the sound generation timing designated by the model performance information has arrived in accordance with the progression of the performance time;

in response to detection of the sound generation timing, determine whether or not the sound indicated by the user performance information matches the sound designated by the model performance information in association with the sound generation timing; and based on a determination that the sound indicated by the user performance information does not match the sound designated by the model performance information:

cause the sound generator circuit to audibly generate an assist sound relating to the sound designated by the model performance information; and control the accompaniment sound generator such that the accompaniment sound is stopped.

2. The performance assistance apparatus as claimed in claim 1, wherein the processor is further configured to wait for a predetermined time from the sound generation timing so that the sound generator circuit audibly generates the assist sound if it is not determined during the predetermined time that the sound indicated by the user performance information matches the sound designated by the model performance information, but does not generate the assist sound if it is determined during the predetermined time that the sound indicated by the user performance information matches the sound designated by the model performance information.

3. The performance assistance apparatus as claimed in claim 1, wherein the processor is further configured to cause the sound generator circuit to stop the assist sound if it is determined, after generation of the assist sound, that the sound indicated by the user performance information matches the sound designated by the model performance information.

4. The performance assistance apparatus as claimed in claim 1, further comprising a performance guide that, on the basis of the model performance information and in accordance with the progression of the performance time, is configured to visually guide the user about a sound to be performed by the user.

5. The performance assistance apparatus as claimed in claim 4, wherein the performance guide is further configured to visually display, at a display timing preceding the sound generation timing, the sound to be performed by the user at the sound generation timing.

6. The performance assistance apparatus as claimed in claim 1, wherein the sound designated by the model performance information corresponds to a sound pitch, and the sound generator circuit audibly generates the assist sound relating to the sound pitch.

7. The performance assistance apparatus as claimed in claim 1, wherein the sound designated by the model performance information corresponds to a percussion instrument sound, and the sound generator circuit audibly generates the assist sound relating to the percussion instrument sound.

8. The performance assistance apparatus as claimed in claim 1, wherein the model performance is a model performance of a music piece to be practiced by the user.

9. The performance assistance apparatus as claimed in claim 1, wherein the assist sound is audibly generated while the progression of the performance time is interrupted.

10. A performance assistance apparatus comprising:

a sound generator circuit;

an accompaniment sound generator configured to audibly generate an accompaniment sound in accordance with a progression of a performance time;

a processor configured to:

acquire model performance information designating, for each sound of a model performance sound generation timing and sound;

progress the performance time at a designated tempo;

in response to a performance operation executed by a user in accordance with the progression of the performance time, acquire user performance information indicative of a sound performed by the user;

detect that the sound generation timing designated by the model performance information has arrived in accordance with the progression of the performance time;

in response to detection of the sound generation timing, determine whether or not the sound indicated by the user performance information matches the sound designated by the model performance information in association with the sound generation timing;

produce accompaniment performance information causing the sound generator circuit to audibly generate an accompaniment sound in accordance with the progression of the performance time; and based on a determination that the sound indicated by the user performance information does not match the sound designated by the model performance information:

cause the sound generator circuit to audibly generate an assist sound relating to the sound designated by the model performance information; and control the accompaniment sound generator such that the accompaniment sound is stopped.

11. A musical instrument comprising:

an apparatus operable by a user;

a sound generator circuit that generates a sound performed on the apparatus;

an accompaniment sound generator configured to audibly generate an accompaniment sound in accordance with a progression of a performance time;

a processor configured to:

acquire model performance information designating, for each sound of a model performance, sound generation timing and sound;

progress the performance time at a designated tempo;

in response to a performance operation executed by a user in accordance with the progression of the performance time, acquire user performance information indicative of a sound performed through the apparatus by the user;

detect that the sound generation timing designated by the model performance information has arrived in accordance with the progression of the performance time;

in response to detection of the sound generation timing, determine whether or not the sound indicated by the user performance information matches the sound designated by the model performance information in association with the sound generation timing; and based on a determination that the sound indicated by the user performance information does not match the sound designated by the model performance information:

cause the sound generator circuit to audibly generate an assist sound relating to the sound designated by the model performance information; and control the accompaniment sound generator such that the accompaniment sound is stopped.

12. A performance assistance method comprising:

generating a model performance using a sound generator circuit;

acquiring, using a processor, model performance information designating, for each sound of the model performance, sound generation timing and sound;

progressing a performance time at a designated tempo;

acquiring, in response to a performance operation executed by a user in accordance with a progression of the performance time, user performance information indicative of the sound performed by the user;

detecting that the sound generation timing designated by the model performance information has arrived in accordance with the progression of the performance time;

determining, in response to detection of the sound generation timing, whether or not the sound indicated by the user performance information matches the sound designated by the model performance information in association with the sound generation timing; and audibly generating, based on a determination that the sound indicated by the user performance information does not match the sound designated by the model performance information, an assist sound relating to the sound designated by the model performance information; and audibly generating an accompaniment sound in accordance with the progression of the performance time, wherein the accompaniment sound is stopped if the sound indicated by the user performance information does not match the sound designated by the model performance information.

13. The performance assistance method as claimed in claim 12, further comprising waiting for a predetermined time from the sound generation timing so that the assist sound is audibly generated if it is not determined during the predetermined time that the sound indicated by the user performance information matches the sound designated by the model performance information, whereas the assist sound is not generated if it is determined during the predetermined time that the sound indicated by the user performance information matches the sound designated by the model performance information.

14. The performance assistance method as claimed in claim 12, further comprising stopping the assist sound if it is determined, after generation of the assist sound, that the sound indicated by the user performance information matches the sound designated by the model performance information.

15. The performance assistance method as claimed in claim 12, further comprising visually guiding the user about a sound to be performed by the user, based on the model performance information and in accordance with the progression of the performance time.

16. The performance assistance method as claimed in claim 15, wherein the step of visually guiding, the user visually displays, at display timing preceding the sound generation timing, the sound to be performed by the user at the sound generation timing.

17. A computer-readable, non-transitory storage medium storing a program executable by one or more processors for performing a performance assistance method, the performance assistance method comprising:

generating a model performance using a sound generator circuit;

acquiring, using the one or more processors, model performance information designating, for each sound of the model performance, sound generation timing and sound;

progressing a performance time at a designated tempo;

acquiring, in response to a performance operation executed by a user in accordance with a progression of the performance time, user performance information indicative of a sound performed by the user;

detecting that the sound generation timing designated by the model performance information has arrived in accordance with the progression of the performance time;

determining, in response to detection of the sound generation timing, whether or not the sound indicated by the user performance information matches the sound designated by the model performance information in association with the sound generation timing; and audibly generating, based on a determination that the sound indicated by the user performance information does not match the sound designated by the model performance information, an assist sound relating to the sound designated by the model performance information; and audibly generating an accompaniment sound in accordance with the progression of the performance time, wherein the accompaniment sound is stopped if the sound indicated by the user performance information does not match the sound designated by the model performance information.

* * * * *